US006595392B2

(12) United States Patent
Barnett

(10) Patent No.: US 6,595,392 B2
(45) Date of Patent: Jul. 22, 2003

(54) SPRAY PUMP APPARATUS

(75) Inventor: Burton Barnett, Rossmoor, CA (US)

(73) Assignee: B & B Company, Pacific Palisades, CA (US)

( * ) Notice: Subject to any disclaimer, the term of this patent is extended or adjusted under 35 U.S.C. 154(b) by 0 days.

(21) Appl. No.: 10/011,854

(22) Filed: Dec. 4, 2001

(65) Prior Publication Data

US 2003/0102335 A1 Jun. 5, 2003

(51) Int. Cl.[7] ..... B65D 35/56

(52) U.S. Cl. ..... 222/105; 222/325; 222/464.3; 222/529

(58) Field of Search ..... 222/95, 105, 83, 222/96, 325, 464.3, 530, 529

(56) References Cited

U.S. PATENT DOCUMENTS

| | | | | | |
|---|---|---|---|---|---|
| 817,054 | A | | 4/1906 | Gay | |
| 2,723,056 | A | * | 11/1955 | Smith | 222/401 |
| 2,744,662 | A | | 5/1956 | Smith et al. | |
| 3,091,372 | A | * | 5/1963 | Tidd | 222/401 |
| 3,198,405 | A | | 8/1965 | Pfeil | |
| 3,300,102 | A | | 1/1967 | Budzich | |
| 3,638,699 | A | * | 2/1972 | Hillinger | 222/105 |
| 4,193,518 | A | * | 3/1980 | Holmes | 222/105 |
| 4,223,809 | A | * | 9/1980 | Martin | 222/105 |
| 4,785,974 | A | | 11/1988 | Rudick et al. | |
| 4,836,416 | A | * | 6/1989 | Shalgi et al. | 222/105 |
| 4,886,212 | A | | 12/1989 | Proctor et al. | |
| 5,137,175 | A | | 8/1992 | Kowalski et al. | |
| 5,226,566 | A | * | 7/1993 | Brandenburg | 222/325 |
| 5,251,787 | A | | 10/1993 | Simson | |
| 5,305,921 | A | * | 4/1994 | Kock et al. | 222/95 |
| 5,348,190 | A | * | 9/1994 | Mizzi et al. | 222/325 |
| 5,398,852 | A | | 3/1995 | Lacy | |
| 5,499,750 | A | | 3/1996 | Mabifold | |
| 5,607,082 | A | | 3/1997 | Cracauer | |
| 5,755,361 | A | | 5/1998 | Restive et al. | |

* cited by examiner

*Primary Examiner*—Philippe Derakshani
(74) *Attorney, Agent, or Firm*—John S. Christopher

(57) ABSTRACT

A spray pump apparatus typically employed in gardening and commercial applications wherein a charged liquid is sprayed in a garden environment or on a floor surface for removing spills, grease or stains. In its most fundamental embodiments the spray pump apparatus for use in spraying: fluids includes an outer housing and a pump assembly in mechanical communication with the outer housing for developing a pressure therein. An integral bladder assembly is mounted within the outer housing and comprises an integrally formed combination of a flexible bladder, a hose and a nozzle. The flexible bladder is subjected to the pressure developed by the pump assembly for expelling a fluid contained within the flexible bladder, wherein the integral bladder assembly is installed in and removed from the outer housing as the integrally formed combination.

20 Claims, 3 Drawing Sheets

SPRAY PUMP APPARATUS

BACKGROUND OF THE INVENTION

1. Technical Field

The present invention relates to spraying devices. More specifically, the present invention relates to methods and apparatus for a spray pump device typically used in garden and commercial applications and having an outer housing that incorporates a hand operated pump assembly and a removable integral bladder assembly wherein a first integral bladder assembly for use in spraying a first fluid can be subsequently replaced with a second identical integral bladder assembly for use in spraying a second fluid.

2. Background Art

The prior art is directed to methods and apparatus for spraying devices typically used for garden and commercial applications.

Small tank spray devices are utilized to dispense a wide variety of fluids ranging from, for example, plant food, fertilizers, insecticides and weed killers in garden applications to chemical cleaners and solvents in commercial applications. Spraying devices known in the art typically include separate components such as tank container having a fill port for introducing the liquid to be sprayed, a hose and a nozzle for directing the sprayed liquid, and a hand operated pump mechanism to create air pressure within the tank. The air pressure is applied over the liquid within the tank for driving the liquid through the hose and expelling it from the nozzle.

In the prior art, small tank sprayers must be maintained in a near vertical orientation to operate properly. This is the case since the liquid to be sprayed must be positioned over, i.e., cover, the output port to which the hose is connected in order for the liquid to be expelled and also to prevent the pressurized air within the tank from escaping.

This requirement limits the use of prior art spraying devices.

Further, once the spraying activity has been completed, the unused liquid must be emptied from the tank and thereafter stored or disposed of. Additionally, the interior surfaces of the tank, hose and nozzle must be flushed with an appropriate medium. The effort required to accomplish this task is dependent upon the composition of the liquid previously used in the tank and the composition of liquids to be subsequently used in the tank, i.e., the next application.

Typically, the tank can be comprised of metal or plastic. Notwithstanding, the material used to fashion the tank must be corrosion resistant to avoid rusting since the liquid to be sprayed comes in direct contact with the inner surface of the tank. If the tank is permitted to corrode, the chemical composition of the liquid to be sprayed could be altered and the use of the liquid may be counter-productive. For example, in gardening applications, if the a pesticide or weed killer is previously used in the tank, residual traces of the previously used chemical might be applied to plants and flowers in a subsequent use of the spraying device. This situation would be detrimental to the plants and flowers and could occur even if the tank, hose and nozzle are flushed after the previous use.

Another consideration is the method of disposal of the fluids used in the spraying device. In prior art spraying devices, typically the contents of the tank must be totally used or subsequently disposed of in a separate container employed for storage. Even in spray pump designs known in the prior art that employ a flexible container within the tank and which include the fluid to be sprayed, the flexible container usually is not removable. Thus, all of the fluid, typically a chemical, must be used since there is no provision for removing and storing the flexible container. Further, the method of disposal of the fluid to be sprayed must be considered and must satisfy all local disposal regulations if a negative environmental impact is possible.

Of the spraying devices known in the prior art, a reusable compression sprayer teaches the use of a disposable plastic bag. The separate components include the plastic bag or bladder, a hose and a nozzle which are separate, i.e., discrete, elements. Other examples of spraying devices also include removable and/or replaceable bladders. A further example is a spray device having a bladder that is filled with water and which is employed to apply pressure to chemicals that contact the inner surface of the tank. This design creates a corrosion problem. In yet another example, a spray pump bladder is employed as a pressure regulator to provide a constant spray pressure.

Thus, there is a need in the art for a spray pump apparatus for use in gardening and commercial applications that includes an outer housing that incorporates a hand operated pump assembly and a removable integral bladder assembly that comprises a flexible bladder having a fill port and a cap and which is integrally formed with a perforated stand pipe and hose, feed-through device and nozzle, and wherein a first integral bladder assembly for use in spraying a first fluid can be subsequently replaced with a second identical integral bladder assembly for use in spraying a second fluid without concern for the intermixing of the previously sprayed fluid with the subsequently sprayed fluid.

DISCLOSURE OF THE INVENTION

Briefly, and in general terms, the present invention provides a new and improved spray pump apparatus typically employed in gardening and commercial applications. Typical examples of such applications can include spraying nutrients in liquid form on plants and flowers or alternately spraying chemicals such as weed killers, or spraying chemical solvents and cleaners on floor surfaces for removing spills, grease and stains.

The spray pump apparatus of the present invention includes a portable device having an outer housing with a generally cylindrical shape. Extending from the top of the outer housing is a handle for actuating a piston of a manual pump assembly. Vertical operation of the handle and piston results in developing a pressure within the outer housing. Located within the outer housing is an integral bladder assembly comprising an integrally formed combination of a flexible bladder, a fill port and a seal cap for containing a fluid to be sprayed, a flexible perforated standpipe positioned within the flexible bladder which becomes an external flexible hose having a spray nozzle attached thereto, and a feed-through device for penetrating a sidewall of the outer housing.

Operation of the handle of the manual pump assembly pressurizes the interior of the outer housing which applies a force to the outer surface of the flexible bladder. The force applied to the flexible bladder causes the liquid within the flexible bladder to enter the perforated standpipe and to charge the external flexible hose. Operation of the spray nozzle releases the liquid in a suitable spray pattern. The pressure within the outer housing can be maintained by operating the handle of the manual pump assembly. The integrally formed combination of the flexible bladder with the fill port and seal cap, flexible perforated standpipe, external flexible hose and spray nozzle, and feed-through device is installed in and removed from the spray pump apparatus as a singular unit.

In a preferred embodiment of the present invention, the cylindrical shaped outer housing includes a top portion and a bottom portion. The manual pump assembly is mounted within the top portion of the outer housing. The top portion and the bottom portion of the outer housing each include a flange surface in combination with a tank flange O-ring seal for sealing the outer housing. Further the flange surface associated with the top portion is releaseably connected to the flange surface associated with the bottom portion of the outer housing with a V-band coupling having an over-the-center latch and safety mechanism. The flange surfaces, the O-ring seal and the V-band coupling collectively function to prevent the pressure developed within the interior of the outer housing from bleeding away. A pressure relief valve is positioned within the top portion of the outer housing.

The present invention is generally directed to a spray pump apparatus typically employed in gardening and commercial applications wherein a charged liquid is sprayed in a garden environment or on a floor surface for removing spills, grease or stains. In its most fundamental embodiment, the spray pump apparatus for use in spraying fluids includes an outer housing and a pump assembly in mechanical communication with the outer housing for developing a pressure therein. An integral bladder assembly is mounted within the outer housing and comprises an integrally formed combination of a flexible bladder, a hose and a nozzle. The flexible bladder is subjected to the pressure developed by the pump assembly for expelling a fluid contained within the flexible bladder, wherein the integral bladder assembly is installed in and removed from the outer housing as the integrally formed combination.

In an alternative embodiment, the cylindrical shaped outer housing of the spray pump apparatus of the present invention exhibits a unitary construction. In the alternative embodiment exhibiting the unitary construction, the outer housing includes a top portal having threads formed on the outer surface thereof. The pump assembly is in mechanical communication with the threaded top portal for developing a pressure within the outer housing. The construction and operation of the integral bladder assembly is duplicate to that described with respect to the preferred embodiment, i.e., the components of the integral bladder assembly are installed in and removed from the outer housing as an integral unit. A threaded closure is provided for sealing the threaded top portal. Finally, a pressure relief valve is positioned within the outer housing adjacent to the threaded top portal.

These and other objects and advantages of the present invention will become apparent from the following more detailed description, taken in conjunction with the accompanying drawings which illustrate the invention, by way of example.

DETAILED DESCRIPTION OF THE INVENTION

The present invention is a spray pump apparatus 100 typically employed in a garden environment or a commercial setting. In the garden environment, the spray pump apparatus 100 typically is employed for spraying nutrients in liquid form on plants and flowers, or in the alternative, spraying chemicals such as weed killers at the appropriate locations.

In a commercial setting, the spray pump apparatus 100 is typically used for spraying chemical solvents and cleaners on, for example, a floor surface in a household or garage environment for removing spills, grease and stains.

Figure 1:
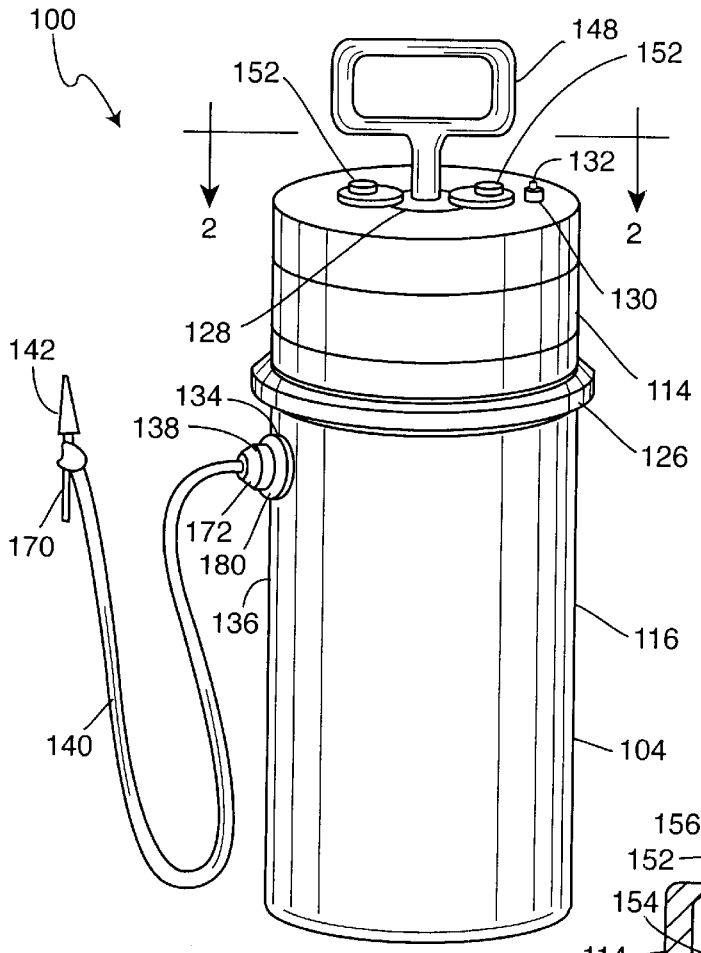
FIG. 1 is a perspective view of a spray pump apparatus having an outer housing comprising a top portion and a bottom portion sealed together with a tank flange clamp ring V-band coupling, and showing a pump handle and an external flexible hose and nozzle.
Figure 2:
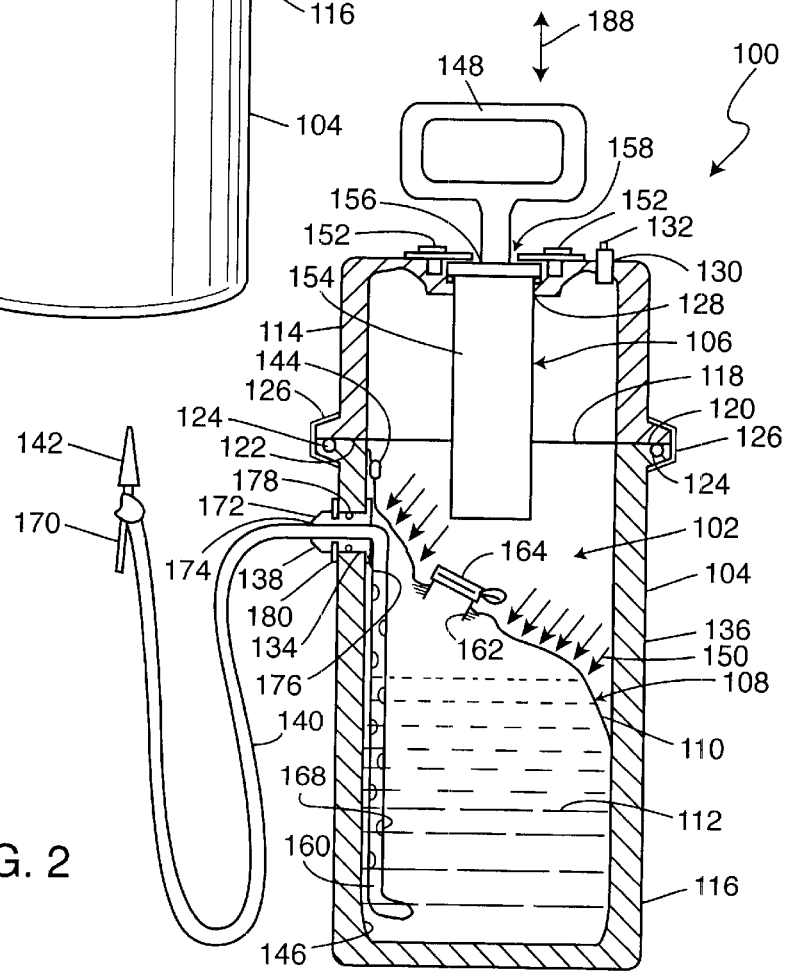
FIG. 2 is a cross-sectional view of the spray pump apparatus taken along line 2—2 of FIG. 1 showing a pump assembly and handle mounted in the top portion and a removable integral bladder assembly mounted in the bottom portion, and showing the outer housing charged with air for applying pressure to a flexible bladder.

In general, the spray pump apparatus 100 is portable, can be conveniently disassembled for accessing an interior area 102 of a generally cylindrical-shaped outer housing 104 which can be pressurized by a pump assembly 106, for example, a manual pump assembly, as shown in FIGS. 1 and 2. Although the pump assembly 106 is described herein as a manual pump assembly 106, it is understood that other suitable pump assemblies could be utilized including a motorized pump, an externally mounted pump or an air pressure fitting compatible with a pressurized air line. The interior area 102 of the outer housing 104 includes a removable integral bladder assembly 108 which contains a flexible bladder 110 including a fluid 112 to be sprayed. Upon completion of spraying a first fluid, the integral bladder assembly 108 can be replaced with a duplicate integral bladder assembly 108 for use in spraying a second fluid without concern for the intermixing of the first sprayed fluid with the subsequently second sprayed fluid. Thereafter, the removed integral bladder assembly 108 can be conveniently stored as described herein below.

The preferred embodiment of the present invention is illustrated in FIGS. 1–6 and includes the generally cylindrical-shaped outer housing 104. The outer housing 104 is comprised of two main components which include a top portion 114 and a bottom portion 116 as is clearly shown in FIG. 2. The top portion 114 and the bottom portion 116 are shown in cross-section in FIG. 2 and both are comprised of any suitable material such as, for example, any metal or high strength plastic capable of withstanding the pressure generated by the pump assembly 106. The top portion 114 and the bottom portion 116 are separable at an interface 118 for installing and removing the integral bladder assembly 108. The top portion 114 of the outer housing 104 includes a flange surface 120 and the bottom portion 116 of the outer housing 104 includes a corresponding flange surface 122. The flange surface 120 and the flange surface 122 meet at the interface 118 as shown in FIG. 2.

Positioned between flange surface 120 and flange surface 122 is a tank flange O-ring seal 124 also shown in FIG. 2. Additionally, the flange surface 120 and the flange surface 122 are releaseably connected with a V-band coupling 126 shown best in FIGS. 1 and 2. The V-band coupling 126 includes an over-the-center latch and safety mechanism (not shown). The flange surface 120, flange surface 122, O-ring seal 124 and V-band coupling 126 collectively function to effectively seal the air pressure within the outer housing 104. In other words, the flange surface 120, flange surface 122, O-ring seal 124 and V-band coupling 126 serve to prevent the pressure developed by the pump assembly 106 within the interior area 102 of the outer housing 104 from bleeding away. Once the top portion 114 of the outer housing 104 is connected to the bottom portion 116 of the outer housing 104, the flange surface 120, flange surface 122, O-ring seal 124 and V-band coupling 126 essentially provide an air tight chamber.

The outer housing 104 is fashioned to include several penetrations therein for accommodating other structural features of the present invention. A first penetration 128 is formed in the top portion 114 for accommodating the manual pump assembly 106 as is clearly shown in FIG. 2. A second penetration 130 is also formed in the top portion 114 for accommodating a pressure relief valve 132. The pressure relief valve 132 serves to relieve and to limit the air pressure within the outer housing 104. A third penetration 134 is formed within a sidewall 136 for accommodating a feed-through device 138. The feed-through device 138 serves to circuit a flexible hose 140 and a spray nozzle 142 of the integral bladder assembly 108 out of the outer housing 104 as is shown best in FIGS. 3 and 4. Finally, the outer housing 104 also includes a hanger mounting bracket 144 mounted on an inside surface 146 of the sidewall 136 which provides a suspension point for the flexible bladder 110 as shown in FIG. 2.

Extending from the top portion 114 of the outer housing 104 is a pump handle 148 utilized for actuating a piston (not shown) of the exemplary manual pump assembly 106 clearly shown in FIGS. 1 and 2. Reciprocal operation of the pump handle 148 in the vertical direction results in developing a pressure within the interior area 102 of the outer housing 104. This pressurization of the interior area 102 applies force to the flexible bladder 110 as is indicated by the force arrows 150 shown in FIG. 2. The initial pressure developed within the interior area 102 of the outer housing 104 can be maintained by subsequent reciprocal operation of the pump handle 148. The manual pump assembly 106 is mounted within the top portion 114 of the outer housing 104 as is shown in FIGS. 1 and 2. The manual pump assembly 106 is held in position by a plurality of bolts 152 threaded into the top portion 114 of the outer housing 104. As will be discussed in more detail herein below, the top portion 114 can be separated from, i.e., pulled away from, the corresponding bottom portion 116 of the outer housing. Generally, this is accomplished by first releasing the pressure in the interior area 102 via the relief valve 132 and then disconnecting the V-band coupling 126. Thereafter, the integral bladder assembly 108 is accessible within the bottom portion 116 of the outer housing 104.

The manual pump assembly 106 employed in the present invention is very similar to air pumps known in the art for use in inflating, for example, bicycle tires. The manual pump assembly 106 comprises the pump handle 148, a pump cylinder 154, a pressurizing piston (not shown), and first and second flapper valves (not shown) for admitting air into and exhausting air from the pump cylinder 154 shown in FIG. 2. At the point where the pump cylinder 154 of the manual pump assembly 106 interfaces with the top portion 114 of the outer housing 104, an air clearance space 156 is provided as is best shown in FIG. 2. The air clearance space 156 provides sufficient space for admission of air into the pump cylinder 154 of the manual pump assembly 106. The air is identified by an arrow labeled 158 in FIG. 2.

Figure 4:
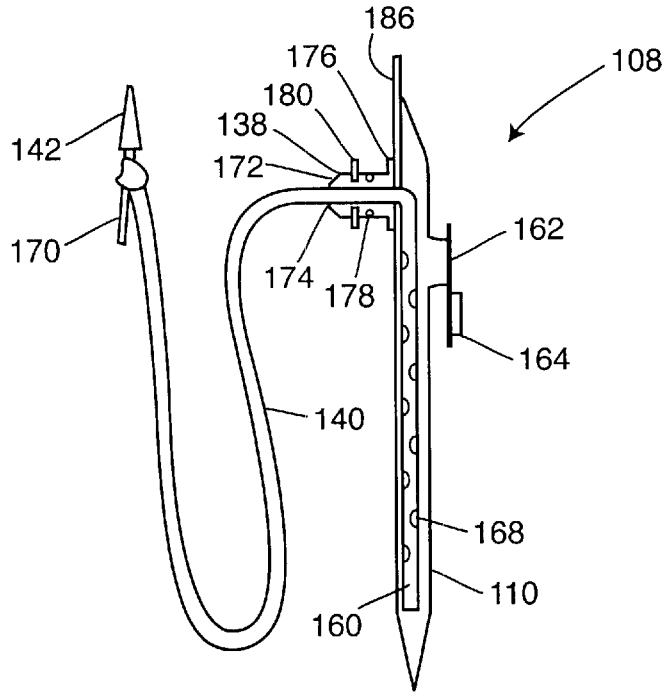
FIG. 4 is a detail view of the removable integral bladder assembly prior to insertion into the bottom portion of the outer housing of the spray pump apparatus showing the integral nature of a flexible bladder, fill port, tethered seal cap, perforated stand pipe, external flexible hose and nozzle.

When the pump handle 148 is withdrawn from the pump cylinder 154, an intake flapper valve (not shown) is opened and air is drawn into and routed to a space below the pressurizing piston (not shown) of the manual pump assembly 106. The pressurizing piston (not shown) is attached to the end of the pump handle 148 and mounted within the pump cylinder 154. When the pump handle 148 is forced downward, i.e., the pressurizing piston is forced down into the pump cylinder 154, the intake flapper valve (not shown) is closed and an exhaust flapper valve (not shown) is opened. The captured air is then directed through the exhaust flapper valve (not shown) and into the interior area 102 for pressurizing the outer housing 104. The air exhausted from the manual pump assembly 106 and into the interior area 102 of the outer housing 104 causes a pressurization between the manual pump assembly 106 and the flexible bladder 110 as is indicated by the force arrows 150 in FIG. 2. It is this pressure applied to the flexible bladder 110 that forces the fluid 112 to be sprayed into a flexible perforated standpipe 160, and the flexible hose 140 and spray nozzle 142 as is best shown in FIGS. 2 and 4.

The integral bladder assembly 108 is located within the outer housing 104 and comprises the integrally formed combination of the flexible bladder 110, the flexible perforated standpipe 160 positioned within the flexible bladder 110 which is continuous with the external flexible hose 140 having the spray nozzle 142 attached thereto, and the feed-through device 138 for penetrating the sidewall 136 of the outer housing 104. The flexible bladder 110 also includes a fill port 162 and a tethered seal cap 164 as is clearly shown in FIGS. 2 and 6. It is noted that the integrally formed combination of the flexible bladder 110 with the fill port 162 and tethered seal cap 164, flexible perforated standpipe 160, external flexible hose 140, spray nozzle 142, and feed-through device 138 is installed in and removed from the spray pump apparatus 100 as a singular unit, i.e., as the integrally formed combination.

Figure 5:
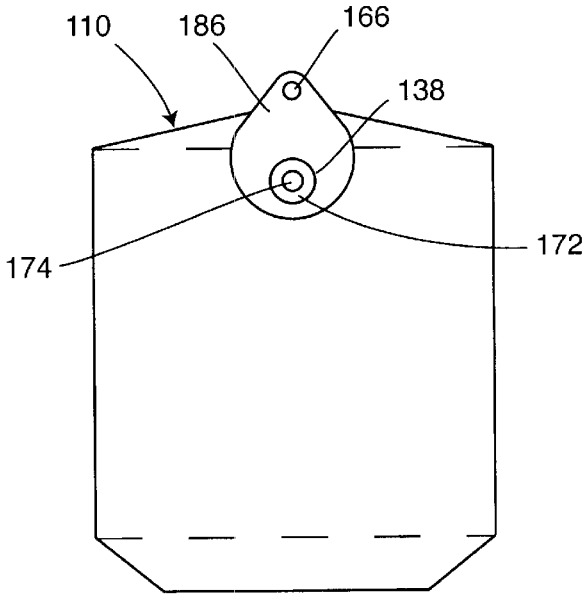
FIG. 5 is a rear elevation view of the removable flexible bladder shown in FIG. 4 illustrating a bladder hanger eyelet and the feed-through device.
Figure 6:
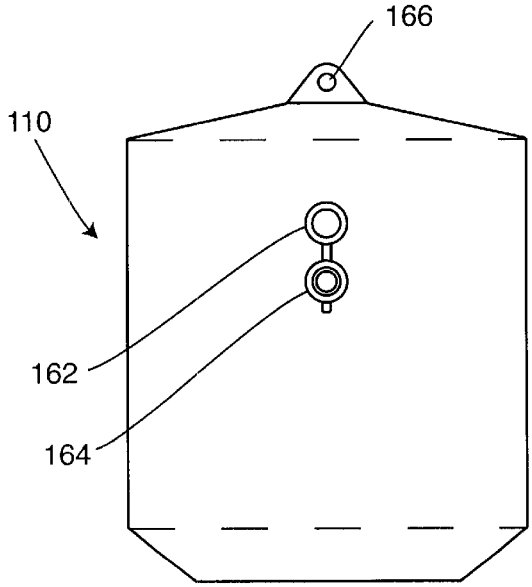
FIG. 6 is a front elevation view of the removable flexible bladder shown in FIG. 4 illustrating the bladder fill port, tethered seal cap, and the bladder hanger eyelet.

The flexible bladder 110 can be comprised of a flexible, liquid-tight container bag such as a disposable plastic bag of suitable gauge and strength as is shown in FIGS. 2, 4, 5 and 6. The flexible bladder 110 can include a generally rectangular shape as shown in FIGS. 5 and 6. However, the flexible bladder 110 can assume any shape that will easily conform to the inside surface 146 of the outer housing 104 when the bladder 110 is filled with the fluid 112 to be sprayed. The fill port 162 with the tethered seal cap 164 is clearly shown in the front elevation of FIG. 6 while the feed-through device 138 is clearly shown in the rear elevation of FIG. 5. The fill port 162 and the tethered seal cap 164 can be comprised of a compatible plastic material and molded to the flexible bladder 110.

The flexible bladder 110 also includes a bladder hanger eyelet 166 which is clearly shown in FIGS. 5 and 6. The hanger eyelet 166 functions as a means for suspending the flexible bladder 110 from the hanger mounting bracket 144 mounted on the inside sidewall 146 of the outer housing 104 as is best shown in FIG. 2. Further, since the flexible bladder 110, perforated standpipe 160, external hose 140, spray nozzle 142, and feed-through device 138 are integrally formed, the entire integral bladder assembly 108 can be suspended from a suitable wall mounted hook using the bladder hanger eyelet 166 once the integral bladder assembly 108 has been removed from the outer housing 104. This design enables the entire integral bladder assembly 108 to be removed and stored together when the flexible bladder 110 is not entirely exhausted of the fluid 112 to be sprayed.

The perforated standpipe 160 is internal to and extends from the very bottom of the flexible bladder 110 to the feed-through device 138 as is Shown in Fig. 2. The perforated standpipe 160 is the pathway by which the fluid 112 to be sprayed is expelled from the flexible bladder 110. The standpipe 160 includes a plurality of perforations 168 positioned along the length thereof to ensure that "pinch-off" does not occur, i.e., the perforations 168 enable free flow of the fluid 112 to be sprayed even if the bottom of the perforated hose 160 is "pinched-off" or the flexible bladder 110 is pinched. Additionally, the plurality of penetrations 168 facilitate fluid flow from the flexible bladder 110 when in any orientation. Thus, the perforated standpipe 160 assists in preventing interruption of the fluid flow.

Figure 3:
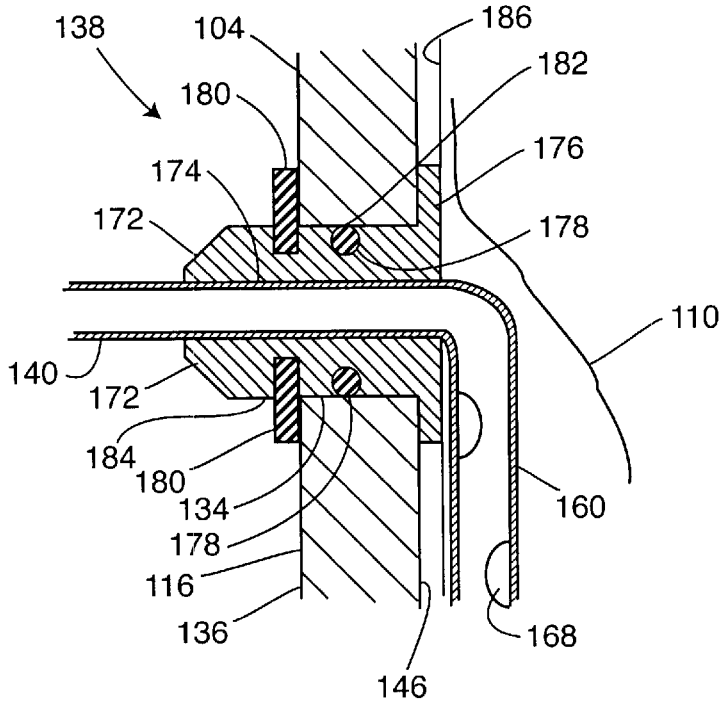
FIG. 3 is an enlarged detail view of a feed-through device passing through a side wall of the outer housing including a feed-through seal and a feed-through retainer clip.

The perforated standpipe 160 is continuous with the external flexible hose 140 as is clearly shown in FIGS. 2, 3 and 4. The perforated standpipe 160 comprising the plurality of perforations 168 becomes the flexible hose 140 upon passing through the feed-through device 138 as is clearly shown in FIG. 3. The flexible hose 140 is of a suitable length and both the flexible hose 140 and the perforated standpipe 160 are comprised of a material consistent with the chemical combination of the fluids 112 to be sprayed. Those fluids 112 can include plant and flower food, liquid fertilizers, chemical weed killers, and industrial solvents and cleaners to name a few. The spray nozzle 142 connected to the flexible hose 140 can be of the type having a spring-operated handle or trigger 170 known in the art. Physical depression of the spring-operated handle or trigger 170 enables the fluid 112 to be sprayed to pass from the flexible bladder 110 through the perforated standpipe 160 and the flexible hose 140 to its intended destination.

The feed-through device 138 is best illustrated in FIG. 3 but is also shown in FIGS. 1, 2, 4 and 5. The feed-through device 138 includes a body 172 having a central penetration 174 passing there through in a horizontal direction, a mounting flange 176 pressed directly against the inside surface 146 of the sidewall 136, a bladder feed-through seal 178, and a feed-through retainer clip 180. The body 172 of the feed-through device 138 can be comprised of a suitable material such as, for example, plastic or other synthetic material, or a rubberized material to name a few. The body 172 includes the central penetration 174 that serves as a horizontal passageway through the feed-through device 138 for the passage of the flexible hose 140 as is shown in Fig. 3.

The mounting flange 176 is integral with the body 172 of the feed-through device 138 and serves in combination with the feed-through retainer clip 180 to hold the feed-through device 138 in position. The feed-through seal 178 can be comprised of a rubber, neoprene, or other synthetic material that is positioned in a groove 182 formed in the body 172 as shown in FIG. 3. The feed-through seal 178 prevents escape of air pressure created within the outer housing 104 by the manual pump assembly 106. The feed-through seal 178 also prevents the loss of any of the fluid 112 to be sprayed in the unlikely event of a rupture of the flexible bladder 110. The feed-through retainer clip 180 is positioned within a slot 184 formed within the body 172 of the feed-through device 138 as is also shown in FIG. 3.

The integrally formed combination of the integral bladder assembly 108 includes the feed-through device 138 which serves to provide a sealed passageway for the flexible hose 140 to exit the outer housing 104. The flexible hose 140 extends between the perforated standpipe 160 and the spray nozzle 142. During assembly, the spray nozzle 142 and flexible hose 140 are passed through the third penetration 134 formed through the sidewall 136 of the outer housing 104. The flexible hose 140 passes through the central penetration 174 of the feed-through device 138. The feed-through device 138 is also passed through the third penetration 134 of the sidewall 136 until the mounting flange 176 contacts the inside surface 146 of the sidewall 136. At that point, the feed-through retainer clip 180 is positioned within the slot 184 for locking the feed-through device 138 in position. Thus, the feed-through retainer clip 180 is employed for holding the flexible hose 140, feed-through device 138, perforated standpipe 160 and the flexible bladder 110 in position through the sidewall 136.

The components of the integrally formed combination of the integral bladder assembly 108 including the flexible bladder 110, perforated standpipe 160, feed-through device 138, flexible hose 140 and spray nozzle 142 are formed as a single unit, i.e., connected together, by Radio Frequency (RF) sealing methods known in the art. The mounting flange 176 of the feed-through device 138 is clearly shown in FIG. 4 sealed to a bladder hanger 186 attached to the flexible bladder 110 as by Radio Frequency (RF) sealing. The bladder hanger 186 is also shown attached to the flexible bladder 110 in Fig. 5. Once the interior area 102 of the outer housing 104 is pressurized by the manual pump assembly 106, the flexible hose 140 becomes charged with the fluid 112 to be sprayed. The combination of the pressurized interior area 102 and the charged flexible hose 140 causes the feed-through device 138 to be securely held in position between the mounting flange 176 and the feed-through retainer clip 180. The feed-through device 138 can be disassembled once pressure in the interior area 102 has been released through the pressure relief valve 132. This is accomplished by removing the feed-through retainer clip 180 and withdrawing the feed-through device 138, flexible hose 140 and spray nozzle 142 back through the third penetration 134 of the sidewall 136.

One of the many advantageous features of the present invention is that the entire integral bladder assembly 108 is replaceable. Thus, a first fluid 112 to be sprayed which is contained in a first integral bladder assembly 108 can be entirely replaced by a second fluid to be sprayed which is contained in a separate, identical second integral bladder assembly 108. This replacement of a first integral bladder assembly 108 with a second integral bladder assembly 108 can be accomplished without concern for the intermixing of the first fluid 112 to be sprayed with the second fluid 112 to be sprayed. Upon the first use of the spray pump apparatus 100 or upon replacement of a first integral bladder assembly 108 with a second integral bladder assembly 108, the following procedure is advised.

If the spray pump apparatus 100 has previously been in use, the pressure within the outer housing 104 must be released. This is accomplished by actuating the pressure relief valve 132 mounted in the top portion 114 of the outer housing 104 as shown in FIGS. 1 and 2. The V-band coupling 126 having the over-the-center latch and safety mechanism is manually released. Thereafter, the top portion 114 of the outer housing 104 is removed from the bottom portion 116. The bladder hanger eyelet 166 is then removed from the hanger mounting bracket 144 for releasing the flexible bladder 110 as shown in FIG. 2. The feed-through retainer clip 180 is physically separated from the slot 184 shown in FIG. 3. Thereafter, the feed-through device 138 along with the flexible hose 140 and spray nozzle 142 are pulled through the third penetration 134 of sidewall 136 of the outer housing 104. Thereafter, the entire integrally formed combination of the integral bladder assembly 108 can be removed from the outer housing 104 as a singular unit. If all of the fluid 112 to be sprayed has not been expelled, the first integral bladder assembly 108 can be suspended from a suitable wall mounted hook using the bladder hanger eyelet 166.

At this point, a separate, identical integral bladder assembly 108 can be installed in the following manner. Initially, the bladder hanger eyelet 166 of the flexible bladder 110 is positioned over the hanger mounting bracket 144 attached to the inside surface 146 of sidewall 136 of the outer housing 104. Next, the spray nozzle 142, flexible hose 140 and feed-through device 138 are extended through the third penetration 134 formed in the sidewall 136. The feed-through device 138 is then manipulated until the mounting flange 176 is positioned against the inside surface 146 of the sidewall 136. Thereafter, the feed-through retainer clip 180 is positioned within the slot 184 formed within the body 172 of the feed-through device 138. The feed-through device 138 is now captured in position between the mounting flange 176 and the feed-through retainer clip 180.

At this point, the flexible bladder 110 of the separate, identical integral bladder assembly 108 is properly suspended within the bottom portion 116 of the outer housing 104. It is intended that the flexible bladder 110 will be available either (a) filled with the fluid 112 to be sprayed, or (b) more typically, containing a powder concentrate of flower or plant food, weed killer, or chemical cleaners and/or solvents. If the flexible bladder 110 contains the powder concentrate, the tethered seal cap 164 is removed from the fill port 162 so that the appropriate volume of water can be added to form the fluid 112 to be sprayed.

The top portion 114 is then reassembled to the bottom portion 116 of the outer housing 104 and the V-band coupling 126 including the over-the-center latch and safety mechanism (not shown) are locked into position. The spray pump apparatus 100 now being reassembled, the pump handle 148 of the manual pump assembly 106 is operated up and down as indicated by the double-headed arrow 188 shown in FIG. 2 to pressurize the interior area 102 of the outer housing 104. The pressure developed within the interior area 102 is applied to the flexible bladder 110 and not to the fluid 112 to be sprayed. In particular, the pressure developed within the interior area 102 is applied through the flexible bladder 110 to the fluid 112 to be sprayed. This action occurs without the developed pressure being applied directly to the fluid 112 to be sprayed.

It is the pressure developed by the manual pump assembly 106 and applied to the flexible bladder 110 that urges the fluid 112 to be sprayed to enter the perforated standpipe 160 and charge the flexible hose 140. Upon actuation of the spring operated handle or trigger 170 of the spray nozzle 142, the fluid 112 to be sprayed is then expelled from the flexible hose 110. When the pressure within the interior area 102 of the outer housing 104 is dissipated, the pump handle 148 can again be operated up and down to re-pressurize the outer housing 104. When the fluid 112 to be sprayed enclosed within the flexible bladder 110 has been exhausted, the integral bladder assembly 108 can be removed and replaced ,if desired, as described herein above.

Figure 7:
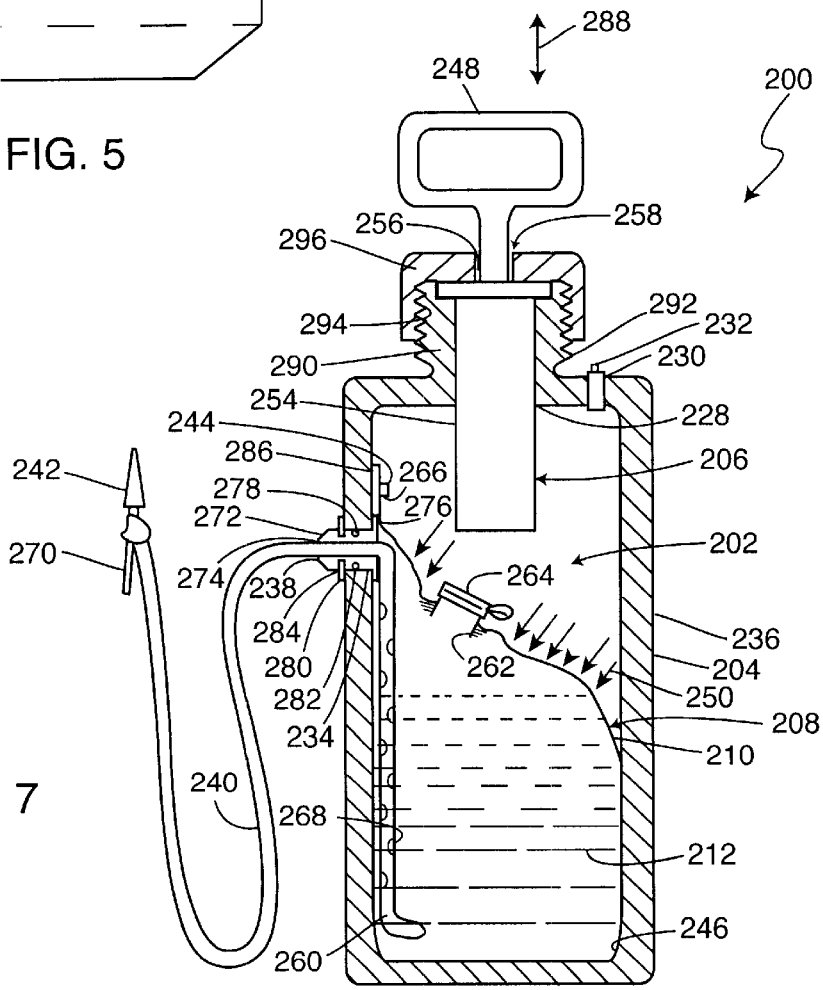
FIG. 7 is a cross-sectional view of an alternative embodiment of the spray pump apparatus of the present invention showing an outer housing exhibiting a unitary construction, and a pump assembly and handle, and a removable integral bladder assembly.

An alternative embodiment of the spray pump apparatus of the present invention is shown in Fig. 7 and is referred to by the identification number 200. Each of the components appearing in the alternative embodiment 200 that correspond in structure and function to those components appearing in the preferred embodiment 100 is identified by the corresponding number of the 200 series.

In general, the spray pump apparatus 200 is portable, includes an interior area 202 positioned within a generally cylindrical-shaped outer housing 204 which can be pressurized by a pump assembly 206, for example, a manual pump assembly, as shown in FIG. 7. Although the pump assembly 206 is described herein as a manual pump assembly 206, it is understood that other suitable pump assemblies could be utilized including a motorized pump, an externally mounted pump or an air pressure fitting compatible with a pressurized air line. The interior area 202 of the outer housing 204 includes a removable integral bladder assembly 208 which contains a flexible bladder 210 including a fluid 212 to be sprayed. Upon completion of spraying a first fluid, the integral bladder assembly 208 can be replaced with a duplicate integral bladder assembly 208 for use in spraying a second fluid without concern for the intermixing of the first sprayed fluid with the second sprayed fluid. Thereafter, the removed integral bladder assembly 208 can be conveniently stored as by hanging on a wall mounted hook (not shown).

The alternative embodiment 200 of the present invention is illustrated in FIG. 7 and includes the generally cylindrical-shaped outer housing 204. The outer housing 204 is characterized by a unitary (one-piece) construction and thus the structural modifications appearing in the alternative embodiment 200 of the present invention are directed to the outer housing 204. The outer housing 204 can be comprised of any suitable material such as, for example, any metal or high strength plastic capable of withstanding the pressure generated by the manual pump assembly 206.

In the spray pump apparatus 200 exhibiting the unitary construction, the outer housing 204 includes a top portal 290 which extends above the outer housing 204. The interior of the upward extending top portal 290 is hollow. The top portal 290 includes a plurality of external threads 292 which cooperate with a corresponding plurality of internal threads 294 of a threaded closure 296 as shown in FIG. 7. The function of the threaded closure 296 is to seal the threaded top portal 290 for maintaining pressure within the interior area 202 of the outer housing 204.

The outer housing 204 is fashioned to include several penetrations therein for accommodating other structural features of the present invention. A first penetration 228 is formed in the outer housing 204 in alignment with the top portal 290 for accommodating the manual pump assembly 206 as is clearly shown in FIG. 7. A second penetration 230 is also formed in the outer housing 204 for accommodating a pressure relief valve 232 for relieving the air pressure within the outer housing 204. A third penetration 234 is formed within a sidewall 236 for accommodating a feed-through device 238. The feed-through device 238 serves to circuit a flexible hose 240 and a spray nozzle 242 of the integral bladder assembly 208 out of the outer housing 204 as shown in FIG. 7. Finally, the outer housing 204 includes a hanger mounting bracket 244 mounted on an inside surface 246 of the sidewall 236 which provides a suspension point for the flexible bladder 210 as shown in FIG. 7.

Extending out of the upward extending top portal 290 and through a clearance space 256 formed in the threaded closure 296 is a pump handle 248. The pump handle 248 is utilized for actuating a piston (not shown) of the manual pump assembly 206 clearly shown in FIG. 7. Reciprocal operation of the pump handle 248 in the vertical direction results in developing a pressure within the interior area 202 of the outer housing 204. This pressurization of the interior area 202 applies force to the flexible bladder 210 as is indicated by the force arrows 250 shown in FIG. 7. The initial pressure developed within the interior area 202 of the outer housing 204 can be maintained by subsequent reciprocal operation of the pump handle 248. The manual pump assembly 206 is mounted within the top portal 290 of the outer housing 204. The manual pump assembly 206 is held in position by the top portal 290 and the threaded closure 296. The integral bladder assembly 208 is accessible through the top portal 290 after the threaded closure 296 and the manual pump assembly 206 have been removed from the outer housing 204.

The manual pump assembly 206 employed in the present invention is very similar to air pumps known in the art for use in inflating, for example, bicycle tires. The manual pump assembly 206 comprises the pump handle 248, a pump cylinder 254, a pressurizing piston (not shown), and first and second flapper valves (not shown) for admitting air into and exhausting air from the pump cylinder 254 as shown in FIG. 7. The pump handle 248 extends through the clearance space 256 formed in the threaded closure 296. That portion of the clearance space 256 that exists between the pump handle 248 and the threaded closure 296 provides an air passageway. Thus, the air passageway formed by the clearance space 256 provides sufficient space for admission of air into the pump cylinder 254 of the manual pump assembly 206. The air is identified by an arrow labeled 258 in FIG. 7.

When the pump handle 248 is withdrawn from the pump cylinder 254, an intake flapper valve (not shown) is opened and air is drawn into and routed to a space below the pressurizing piston (not shown) of the manual pump assembly 206. The pressurizing piston (not shown) is attached to the end of the pump handle 248 and mounted within the pump cylinder 254. When the pump handle 248 is forced downward, i.e., the pressurizing piston is forced down into the pump cylinder 254, the intake flapper valve (not shown) is closed and an exhaust flapper valve (not shown) is opened. The captured air is then directed through the exhaust flapper valve (not shown) and into the interior area 202 for pressurizing the outer housing 204. The air exhausted from the manual pump assembly 206 and into the interior area 202 of the outer housing 204 causes a pressurization between the manual pump assembly 206 and the flexible bladder 210 as is indicated by the force arrows 250 in FIG. 7. It is this pressure applied to the flexible bladder 210 that forces the fluid 212 to be sprayed into a flexible perforated standpipe 260, and the flexible hose 240 and spray nozzle 242.

The integral bladder assembly 208 is located within the outer housing 204 and comprises the integrally formed combination of the flexible bladder 210, the flexible perforated standpipe 260 positioned within the flexible bladder 210 which is continuous with the external flexible hose 240 having the spray nozzle 242 attached thereto, and the feed-through device 238 for penetrating the sidewall 236 of the outer housing 204. The flexible bladder 210 also includes a fill port 262 and a tethered seal cap 264 as is clearly shown in FIG. 7. It is noted that the integrally formed combination of the flexible bladder 210 with the fill port 262 and tethered seal cap 264, flexible perforated standpipe 260, external flexible hose 240, spray nozzle 242, and feed-through device 238 is installed in and removed from the spray pump apparatus 200 as a singular unit, i.e., as the integrally formed combination.

The flexible bladder 210 can be comprised of a flexible, liquid-tight container bag such as a disposable plastic bag of suitable gauge and strength as is shown in FIG. 7. The flexible bladder 210 can include a generally rectangular shape also shown in FIG. 7. However, the flexible bladder 210 can assume any shape that will easily conform to the inside surface 246 of the outer housing 204 when the bladder 210 is filled with the fluid 212 to be sprayed. The fill port 262 with the tethered seal cap 264 and the feed-through device 238 are also clearly shown. The fill port 262 and the tethered seal cap 264 can be comprised of a compatible plastic material and molded to the flexible bladder 210.

The flexible bladder 210 also includes a bladder hanger eyelet 266. The hanger eyelet 266 functions as a means for suspending the flexible bladder 210 from the hanger mounting bracket 244 mounted on the inside sidewall 246 of the outer housing 204. Further, since the flexible bladder 210, perforated standpipe 260, external hose 240, spray nozzle 242, and feed-through device 238 are integrally formed, the entire integral bladder assembly 208 can be suspended from a suitable wall mounted hook using the bladder hanger eyelet 266 once the integral bladder assembly 208 has been removed from the outer housing 204. This design enables the entire integral bladder assembly 208 to be removed and stored together when the flexible bladder 210 is not entirely exhausted of the fluid 212 to be sprayed.

The perforated standpipe 260 is internal to and extends from the very bottom of the flexible bladder 210 to the feed-through device 238 as is shown in FIG. 7. The perforated standpipe 260 is the pathway by which the fluid 212 to be sprayed is expelled from the flexible bladder 210. The standpipe 260 includes a plurality of perforations 268 positioned along the length thereof to ensure that "pinch-off" does not occur, i.e., the perforations 268 enable free flow of the fluid 212 to be sprayed even if the bottom of the perforated hose 260 is "pinched-off" or the flexible bladder 210 is pinched. Additionally, the plurality of penetrations 268 facilitate fluid flow from the flexible bladder 210 when in any orientation. Thus, the perforated standpipe 260 assists in preventing interruption of the fluid flow.

The perforated standpipe 260 is continuous with the external flexible hose 240 as is clearly shown in FIG. 7. The perforated standpipe 260 comprising the plurality of perforations 268 becomes the flexible hose 240 upon passing through the feed-through device 238. The flexible hose 240 is of a suitable length and both the flexible hose 240 and the perforated standpipe 260 are comprised of a material consistent with the chemical combination of the fluids 212 to be sprayed. Those fluids 212 can include plant and flower food, liquid fertilizers, chemical weed killers, and industrial solvents and cleaners to name a few. The spray nozzle 242 connected to the flexible hose 240 can be of the type having a spring-operated handle or trigger 270 known in the art. Physical depression of the spring-operated handle or trigger 270 enables the fluid 212 to be spray to pass from the flexible bladder 210 through the perforated standpipe 260 and the flexible hose 240 to its intended destination.

The feed-through device 238 is identical to that described in reference to FIG. 3. The feed-through device 238 includes a body 272 having a central penetration 274 passing there through in a horizontal direction, a mounting flange 276 pressed directly against the inside surface 246 of the sidewall 236, a bladder feed-through seal 278, and a feed-through retainer clip 280. The body 272 of the feed-through device 238 can be comprised of a suitable material such as, for example, plastic or other synthetic material, or a rubberized material to name a few. The body 272 includes the central penetration 274 that serves as a horizontal passageway through the feed-through device 238 for the passage of the flexible hose 240 as is shown in Fig. 7.

The mounting flange 276 is integral with the body 272 of the feed-through device 238 and serves in combination with the feed-through retainer clip 280 to hold the feed-through device 238 in position. The feed-through seal 278 can be comprised of a rubber, neoprene, or other synthetic material that is positioned in a groove 282 formed in the body 272 as shown in FIG. 7. The feed-through seal 278 prevents escape of air pressure created within the outer housing 204 by the manual pump assembly 206. The feed-through seal 278 also prevents the loss of any of the fluid 212 to be sprayed in the unlikely event of a rupture of the flexible bladder 210. The feed-through retainer clip 280 is positioned within a slot 284 formed within the body 272 of the feed-through device 238 as is also shown in FIG. 7.

The integrally formed combination of the integral bladder assembly 208 includes the feed-through device 238 which serves to provide a sealed passageway for the flexible hose 240 to exit the outer housing 204. The flexible hose 240 extends between the perforated standpipe 260 and the spray nozzle 242. During assembly, the spray nozzle 242 and flexible hose 240 are passed through the third penetration 234 formed through the sidewall 236 of the outer housing 204. The flexible hose 240 passes through the central penetration 274 of the feed-through device 238. The feed-through device 238 is also passed through the third penetration 234 of the sidewall 236 until the mounting flange 276 contacts the inside surface 246 of the sidewall 236. At that point, the feed-through retainer clip 280 is positioned within the slot 284 for locking the feed-through device 238 in position. Thus, the feed-through retainer clip 280 is employed for-holding the flexible hose 240, feed-through device 238, perforated standpipe 260 and the flexible bladder 210 in position through the sidewall 236.

The components of the integrally formed combination of the integral bladder assembly 208 including the flexible bladder 210, perforated standpipe 260, feed-through device 238, flexible hose 240 and spray nozzle 242 are formed as a single unit, i.e., connected together, by Radio Frequency (RF) sealing methods known in the art. The mounting flange 276 of the feed-through device 238 is clearly shown in Fig. 7 sealed to a bladder hanger 286 attached to the flexible bladder 210 as by Radio Frequency (RF) sealing. The bladder hanger 286 is also shown attached to the flexible bladder 210.

Once the interior area 202 of the outer housing 204 is pressurized by the manual pump assembly 206, the flexible hose 240 becomes charged with the fluid 212 to be sprayed. The combination of the pressurized interior area 202 and the charged flexible hose 240 causes the feed-through device 238 to be securely held in position between the mounting flange 276 and the feed-through retainer clip 280. The feed-through device 238 can be disassembled once pressure in the interior area 202 has been released through the pressure relief valve 232. This is accomplished by removing the feed-through retainer clip 280 and withdrawing the feed-through device 238, flexible hose 240 and spray nozzle 242 back through the third penetration 234 of the sidewall 236.

One of the many advantageous features of the present invention is that the entire integral bladder assembly 208 is replaceable. Thus, a first fluid 212 to be sprayed which is contained in a first integral bladder assembly 208 can be entirely replaced by a second fluid to be sprayed which is contained in a separate, identical second integral bladder assembly 208. This replacement of a first integral bladder assembly 208 with a second integral bladder assembly 208 can be accomplished without concern for the intermixing of the first fluid 212 to be sprayed with the second fluid 212 to be sprayed. Upon the first use of the spray pump apparatus 200 or upon replacement of a first integral bladder assembly 208 with a second integral bladder assembly 208, the following procedure is advised.

If the spray pump apparatus 200 has previously been in use, the pressure within the outer housing 204 must be released. This is accomplished by actuating the pressure relief valve 232 mounted in the outer housing 204 as shown in FIG. 7. The threaded closure 296 is then un-threaded and removed from the top portal 290 as is shown in FIG. 7. Thereafter, the threaded closure 296 and the entire manual pump assembly 206 is removed from the outer housing 204. The interior area 202 of the outer housing 204 is now accessible by hand. The bladder hanger eyelet 266 is then removed from the hanger mounting bracket 244 for releasing the flexible bladder 210. The feed-through retainer clip 280 is physically separated from the slot 284 shown in FIG. 7. Then, the feed-through device 238 along with the flexible hose 240 and spray nozzle 242 are pulled through the third penetration 234 of sidewall 236 of the outer housing 204. Thereafter, the entire integrally formed combination of the integral bladder assembly 208 can be removed as a singular unit from the outer housing 204 through the top portal 290. If all of the fluid 212 to be sprayed has not been expelled, the first integral bladder assembly 208 can be suspended from a suitable wall mounted hook for subsequent use by employing the bladder hanger eyelet 266.

At this point, a separate, identical integral bladder assembly 208 can be installed in the following manner. Initially, the bladder hanger eyelet 266 of the flexible bladder 210 is positioned over the hanger mounting bracket 244 attached to the inside surface 246 of sidewall 236 of the outer housing 204. Next, the spray nozzle 242, flexible hose 240 and feed-through device 238 are extended through the third penetration 234 formed in the sidewall 236. The feed-through device 238 is then manipulated until the mounting flange 276 is positioned against the inside surface 246 of the sidewall 236. Thereafter, the feed-through retainer clip 280 is positioned within the slot 284 formed within the body 272 of the feed-through device 238. The feed-through device 238 is now captured in position between the mounting flange 276 and the feed-through retainer clip 280. At this point, the flexible bladder 210 of the separate, identical integral bladder assembly 208 is properly suspended within the outer housing 204. It is intended that the flexible bladder 210 will be available either (a) filled with the fluid 212 to be sprayed, or (b) more typically, containing a powder concentrate of flower or plant food, weed killer, or chemical cleaners and/or solvents. If the flexible bladder 210 contains the powder concentrate, the tethered seal cap 264 is removed from the fill port 262 so that the appropriate volume of water can be added to form the fluid 212 to be sprayed.

The manual pump assembly 206 and the threaded closure 296 are then repositioned within the top portal 290. The internal threads 294 of the threaded closure 296 are then re-threaded to the external threads 292 of the top portal 290 so that the outer housing 204 is re-assembled. The spray pump apparatus 200 now being reassembled, the pump handle 248 of the manual pump assembly 206 is operated up and down as indicated by the double-headed arrow 288 shown in FIG. 7 to pressurize the interior area 202 of the outer housing 204. The pressure developed within the interior area 202 is applied to the flexible bladder 210 and not to the fluid 212 to be sprayed. In particular, the pressure developed within the interior area 202 is applied through the flexible bladder 210 to the fluid 212 to be sprayed. This action occurs without the developed pressure being applied directly to the fluid 212 to be sprayed.

It is the pressure developed by the manual pump assembly 206 and applied to the flexible bladder 210 that urges the fluid 212 to be sprayed to enter the perforated standpipe 260 and charge the flexible hose 240. Upon actuation of the spring operated handle or trigger 270 of the spray nozzle 242, the fluid 212 to be sprayed is then expelled from the flexible hose 210. When the pressure within the interior area 202 of the outer housing 204 is dissipated, the pump handle 248 can again be operated up and down to re-pressurize the outer housing 204. When the fluid 212 to be sprayed enclosed within the flexible bladder 210 has been exhausted, the integral bladder assembly 208 can be removed and replaced, if desired, as described herein above.

The spray pump apparatus 100 of the present invention provides novel advantages over other spray pump devices known in the prior art. A main advantage of the spray pump apparatus 100 of the present invention is that the integral bladder assembly 108 comprises the integrally formed combination of the flexible bladder 110, perforated standpipe 160, feed-through device 138, flexible hose 140 and spray nozzle 142. Another main advantage is that each of the components of the integrally formed combination are installed and replaced within the outer housing 104 as a singular unit. Another advantage is that an integral bladder assembly 108 having a first flexible bladder 110 containing a first fluid 112 to be sprayed can be completely replaced with a separate, identical integral bladder assembly 108 having a second flexible bladder 110 containing a second fluid 112 to be sprayed without any concern for the intermixing of the two separate fluids 212 to be sprayed. Further advantages are that the flexible bladder 110 includes a bladder hanger eyelet 166 for enabling the flexible bladder 110 to be suspended from a hanger mounting bracket 144 within the outer housing 104 or, in the alternative, suspended from a wall mounted hook for storage when not being used. Additionally, the flexible standpipe 160 is positioned internal to the flexible bladder 110 and includes a plurality of perforations 168 along its length to (a) facilitate flow of the fluid 112 to be sprayed in any orientation of the flexible bladder 110, and (b) avoid interruption of the flow due to pinching of the flexible bladder 110. Also, the outer housing 104 can be quickly separated into the top portion 114 and the bottom portion 116 utilizing the V-band coupling 126 to allow easy installation and removal of the flexible bladder 110. Finally, use of the removable flexible bladder 110 eliminates the requirement of flushing the interior of the outer housing 104 after each use.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

It is therefore intended by the appended claims to cover any and all such modifications, applications and embodiments within the scope of the present invention. Accordingly,

What is claimed is:

1. A spray pump apparatus for use in spraying fluids comprising:

an outer housing;

a pump assembly in mechanical communication with said outer housing for developing a pressure within said outer housing; and an integral bladder assembly mounted within said outer housing and comprising an integrally formed combination of a flexible bladder, a hose and a nozzle, wherein said flexible bladder is subjected to said pressure developed by said pump assembly for expelling a fluid contained within said flexible bladder, and wherein said integral bladder assembly is installed in and removed from said outer housing as said integrally formed combination.

2. The spray pump apparatus of claim 1 wherein said flexible bladder further includes a fill port for inserting a fluid into said flexible bladder.

3. The spray pump apparatus of claim 1 wherein said flexible bladder further includes a tethered cap for sealing said flexible bladder.

4. The spray pump apparatus of claim 1 further including a flexible perforated standpipe positioned within said flexible bladder for facilitating the flow of said fluid.

5. The spray pump apparatus of claim 1 wherein said integrally formed combination of said integral bladder assembly further includes a feed-through device for circuiting said hose out of said outer housing.

6. The spray pump apparatus of claim 5 further including a retainer clip for securing said feed-through device in position in said outer housing.

7. The spray pump apparatus of claim 1 further including a hanger mounting bracket for supporting said flexible bladder within said outer housing.

8. The spray pump apparatus of claim 1 further including a pressure relief valve mounted within said outer housing for relieving pressure within said outer housing.

9. The spray pump apparatus of claim 1 wherein said flexible bladder further includes a hanger eyelet for suspending said flexible bladder within said outer housing.

10. A spray pump apparatus for use in spraying fluids comprising:

an outer housing having a top portion coupled to a bottom portion;

a pump assembly in mechanical communication with said top portion for developing a pressure within said outer housing; and an integral bladder assembly mounted within said outer housing and comprising an integrally formed combination of a flexible bladder, a hose, a flexible perforated standpipe and a nozzle, wherein said flexible bladder is subjected to said pressure developed by said pump assembly for expelling a fluid contained within said flexible bladder, and wherein said integral bladder assembly is installed in and removed from said outer housing as said integrally formed combination.

11. The spray pump apparatus of claim 10 wherein said top portion and said bottom portion of said outer housing each include a flange surface in combination with a seal for maintaining said pressure developed within said outer housing.

12. The spray pump apparatus of claim 10 wherein said top portion is coupled to said bottom portion with a V-band coupling.

13. The spray pump apparatus of claim 10 wherein said flexible bladder further includes a fill port and a tethered cap for inserting a fluid into and for sealing said flexible bladder.

14. The spray pump apparatus of claim 10 wherein said flexible perforated standpipe is positioned within said flexible bladder for facilitating the flow of said fluid.

15. The spray pump apparatus of claim 10 further including a hanger mounting bracket for supporting said flexible bladder within said outer housing.

16. A spray pump apparatus for use in spraying fluids comprising:

an outer housing of unitary construction having a threaded top portal;

a pump assembly in mechanical communication with said threaded top portal for developing a pressure within said outer housing; and an integral bladder assembly mounted within said outer housing and comprising an integrally formed combination of a flexible bladder, a hose, a flexible perforated standpipe and a nozzle, wherein said flexible bladder is subjected to said pressure developed by said pump assembly for expelling a fluid contained within said flexible bladder, and wherein said integral bladder assembly is installed in and removed from said outer housing as said integrally formed combination.

17. The spray pump apparatus of claim 16 further including a threaded closure for sealing said threaded top portal.

18. The spray pump apparatus of claim 16 wherein said flexible bladder further includes a fill port and a tethered cap for inserting a fluid into and for sealing said flexible bladder.

19. The spray pump apparatus of claim 16 wherein said flexible perforated standpipe is positioned within said flexible bladder for facilitating the flow of said fluid.

20. The spray pump apparatus of claim 16 further including a hanger mounting bracket for supporting said flexible bladder within said outer housing.

* * * * *